US008517004B2

(12) United States Patent
Walterscheid

(10) Patent No.: US 8,517,004 B2
(45) Date of Patent: Aug. 27, 2013

(54) PNEUMATIC TOY LAUNCHER WITH A FLEXIBLE BARREL

(75) Inventor: Steve Walterscheid, Bend, OR (US)

(73) Assignee: KMA Concepts Limited, Kowloon (HK)

( * ) Notice: Subject to any disclaimer, the term of this patent is extended or adjusted under 35 U.S.C. 154(b) by 0 days.

(21) Appl. No.: 13/277,207

(22) Filed: Oct. 19, 2011

(65) Prior Publication Data

US 2013/0098345 A1 Apr. 25, 2013

(51) Int. Cl.
*F41B 11/24* (2006.01)

(52) U.S. Cl.
USPC ..... 124/64

(58) Field of Classification Search
USPC ..... 124/56, 60, 61, 63–65, 67, 69, 70–71, 124/73–76, 83–85; 42/54–55
See application file for complete search history.

(56) References Cited

U.S. PATENT DOCUMENTS 4,548,190 A * 10/1985 Megargee ..... 124/56
4,570,607 A * 2/1986 Stokes ..... 124/56
5,701,878 A * 12/1997 Moore et al. ..... 124/67

* cited by examiner

*Primary Examiner* — Stephen M Johnson
*Assistant Examiner* — John D Cooper
(74) *Attorney, Agent, or Firm* — LaMorte & Associates P.C.

(57) ABSTRACT

A toy system for launching a soft dart projectile. The dart projectile has a flexible shaft. A pneumatic launcher is used to launch the dart projectile. The pneumatic launcher contains an air pulse generating system that displaces air through a flexible barrel. The flexible barrel defines an internal conduit that extends between a first end and a second end. The second end of the flexible barrel is sized to receive the shaft of the dart projectile. The flexible barrel is fabricated from a flexible closed-cell foam that enables said flexible barrel to bend at least ninety degrees without blocking airflow through its internal conduit. As a result, the toy pneumatic launcher can be directed in a first direction, while the barrel is bent to fire in a second direction. The flexible barrel has features that prevent the dart projectile from binding in the barrel when the barrel is bent.

17 Claims, 4 Drawing Sheets

PNEUMATIC TOY LAUNCHER WITH A FLEXIBLE BARREL

BACKGROUND OF THE INVENTION

1. Field of the Invention

In general, the present invention relates to toy projectile launchers that launch soft projectiles using pneumatic force. More particularly, the present invention relates to the barrel structure used in such toy projectile launchers.

2. Prior Art Description

Toy dart guns have been a popular play toy for more than a century. As toy safety standards have evolved, hard plastic darts with suction cup heads have become replaced with soft foam darts.

Foam darts do not have much mass. As a result, it was soon recognized that foam darts need not be launched by a compressed spring or an elastic band. Rather, it has been discovered that foam darts can be launched long distances by only a short burst of air.

There are many mechanical and electrical ways to produce a burst of air. For example, many Nerf® toy guns use spring-loaded pistons that generate a short burst of air when cocked and released. However, one of the simplest ways to generate the needed burst of air is to provide an air bladder. When the air bladder is squeezed, a burst of air is created. The strength of the burst or air is directly proportional to the force used to compress the air bladder.

In order to place an air bladder in a toy gun and still maintain the shape of a traditional gun, manufacturers have formed air bladders into the handle of the gun. When a child is holding the toy gun, the child need only squeeze the handle in order for the burst of air to be created. The burst of air is directed into the barrel of the toy gun. A foam dart is placed in the barrel. The burst of air builds behind the foam dart in the barrel and launches the foam dart into flight out of the barrel. Such prior art toy guns are sold under the trade name Pop-Shotz®, by Zing Toys, Inc. of Banks, Oreg., the assignee herein.

Although many toy companies have made dart guns that launch foam darts with bursts of air, all of the known prior art toy guns have had rigid fixed barrels. That is, the barrel of the toy gun is set in a fixed position and the foam dart launches in the same direction as the barrel points. Although such limitations of construction were necessary in the past for hard plastic darts that were spring launched from a barrel, such limitations are not necessary for the new foam darts that are pneumatically launched.

Accordingly, the present invention sets forth an improvement in the art of pneumatically operated toy dart guns, wherein the barrel is flexible and can be turned in numerous directions. In this manner, the toy gun can shoot in many directions other than straight for added play value. This improvement is described and claimed below.

SUMMARY OF THE INVENTION

The present invention is a toy system for launching a soft dart projectile. The dart projectile has a head and a flexible shaft. The flexible shaft has a outside diameter. A pneumatic launcher is used to launch the dart projectile. The pneumatic launcher contains an air pulse generating system that displaces air through a flexible barrel. The flexible barrel defines an internal conduit that extends between a first end and a second end. The second end of the flexible barrel is sized to receive the shaft of the dart projectile. The flexible barrel is fabricated from a flexible closed-cell foam that enables said flexible barrel to bend at least ninety degrees between its first end and its second end without blocking air flow through its internal conduit. As a result, the toy pneumatic launcher can be directed in a first direction, while the barrel is bent to fire in a second direction. The flexible barrel has features that prevent the dart projectile from binding in the barrel when the barrel is severely bent.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy system can be embodied in many ways, the embodiments illustrated show the toy system configured as dart pistols. These embodiments are selected in order to set forth the best modes contemplated for the invention. The illustrated embodiments, however, are merely exemplary and should not be considered a limitation when interpreting the scope of the appended claims.

Figure 1:
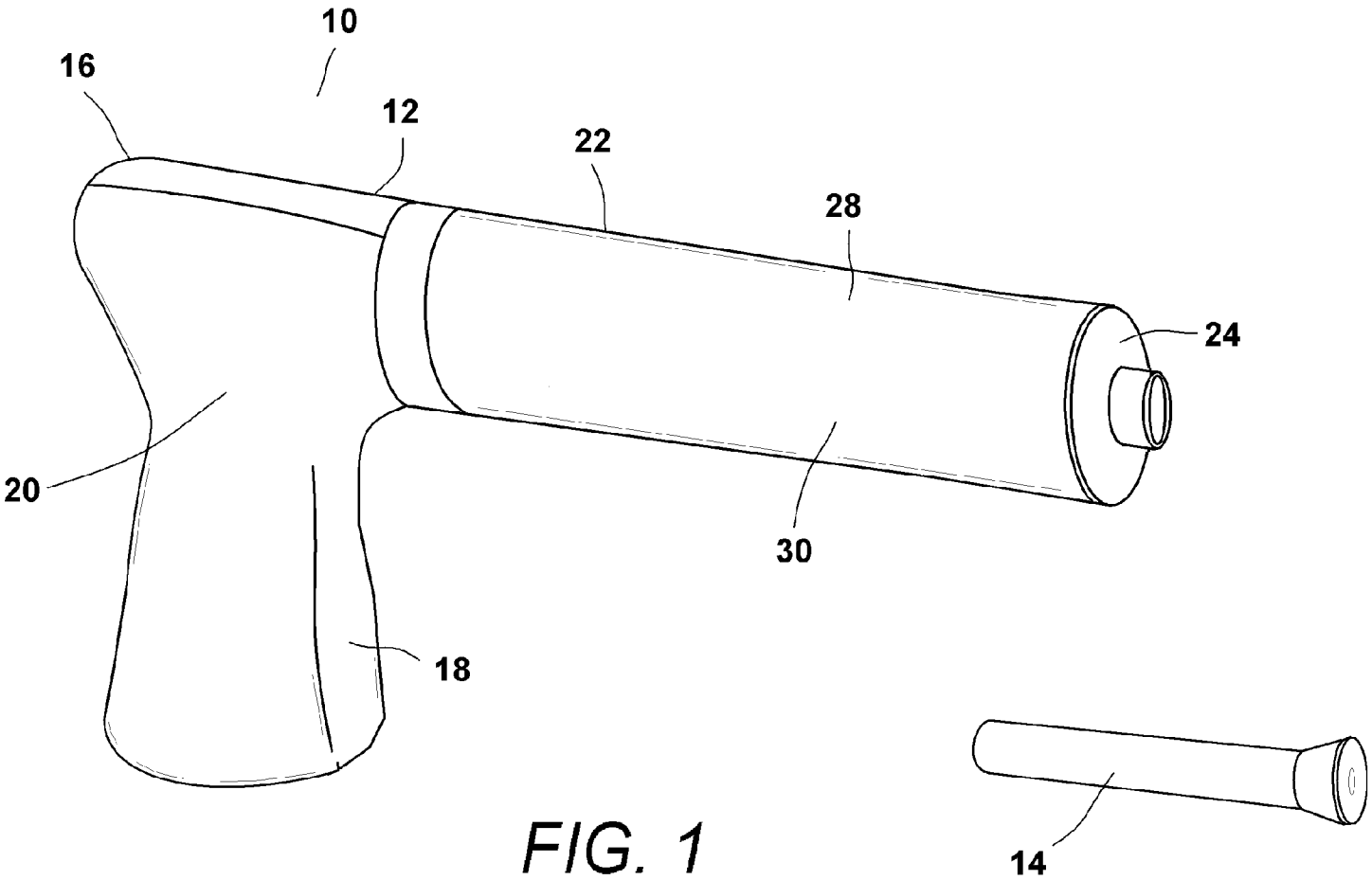
FIG. 1 is a perspective view of an exemplary embodiment of a system containing a toy launcher and a toy projectile.
Figure 2:
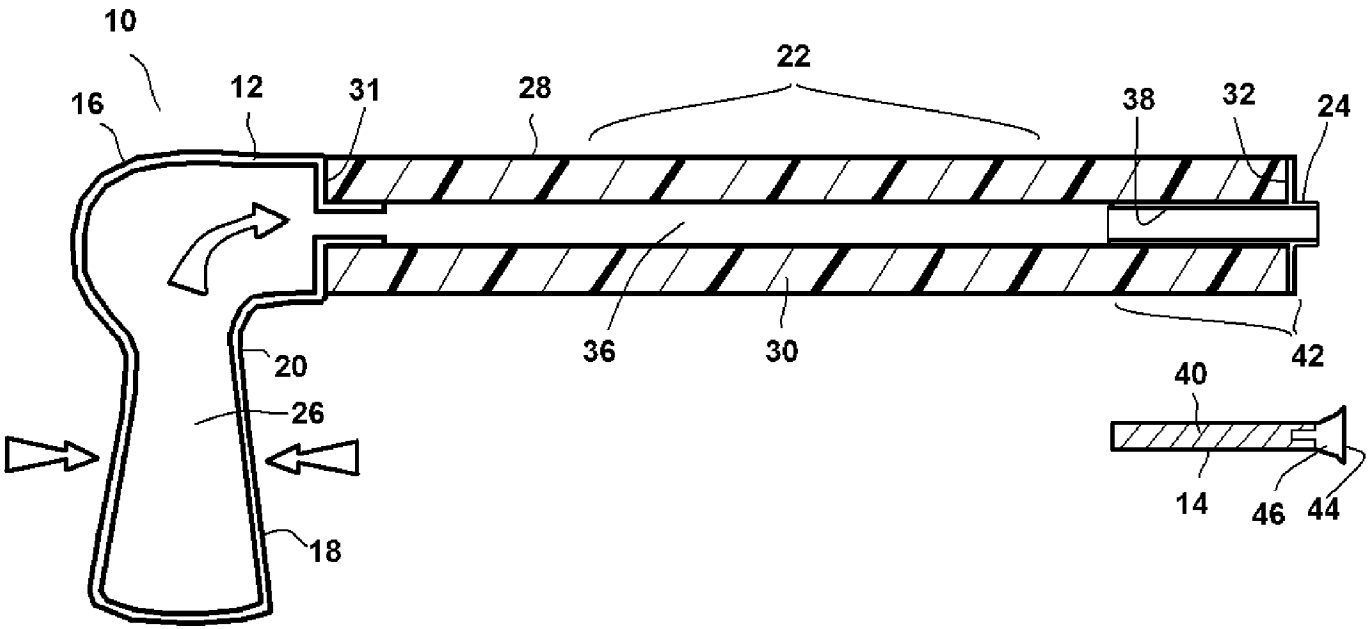
FIG. 2 is a cross section of the exemplary embodiment of FIG. 1.

Referring to FIG. 1 and FIG. 2, a toy system 10 is shown that includes both a toy launcher 12 and a soft dart projectile 14. The toy launcher 12 fires the soft dart projectile 14 into flight using pneumatics. In the exemplary embodiment, the toy launcher 12 is configured as a toy gun 16, having a handle section 18, a gun body 20, a barrel section 22 and a barrel tip 24.

The handle section 18 and the gun body 20 of the toy gun 16 are molded as a single unit from soft plastic. The handle section 18 and the gun body 20 are both hollow and define a continuous internal chamber 26 that serves as an air bladder. Since the handle section 18 and the gun body 20 are soft, it will be understood that a person can hold the handle section 18 and squeeze the handle section 18 into a collapsed condition. As the handle section 18 is compressed, the volume of the internal chamber 26 deceases. The air from within the handle section 18 is then displaced through the gun body 20 and into the barrel section 22. Accordingly, the handle section 18 and the gun body 20 of the toy gun 16 act as a compressible air bladder.

The barrel section 22 of the toy gun 16 is made from a tube 28 of closed cell foam 30. The tube 28 has a first end 31 and a second end 32. The first end 31 of the tube 28 is bonded to the gun body 20 with an air impervious seal. Accordingly, air can only exit the internal chamber 26 through the tube 28. The dimensions of the tube 28 are important to the functionality of the toy system 10. The barrel section 22 has a preferred outside diameter of between one and three inches. The thickness of the tube 28 depends upon the size of the soft dart projectile 14 and the corresponding size of the internal conduit 36 within the tube 28. The diameter of the internal conduit 36 is slightly larger than the diameter of the shaft of the dart projectile 14. The outside diameter of the tube 28 must be at least twice as wide as the diameter of the inside conduit 36 in order to prevent the walls of the tube 28 from kinking closed when bent. If the wall thickness of the tube 28 were any less, the tube 28 could kink and close the internal conduit 36, therein obstructing air flow through the tube 28.

The ample wall thickness of the tube 28 also ensures that the tube 28 has resiliency and will automatically return to a generally linear configuration whenever a bending force is removed. The wall thickness of the tube 28 also ensures that the tube 28 will not bend down on its own under the influence of gravity. As such, the barrel section 22 of the toy gun 16 will remain straight unless intentionally bent. Furthermore, it will automatically return to that straight configuration after each time it is bent.

The length of the tube 28 is also important to ensure bending without kinking. The length of the tube 28 must be at least four times as long as the outside diameter of the tube 28 to ensure that the tube 28 can bend without kinking.

The barrel tip 24 is made of hard plastic and is adhered to the closed cell foam 30 at the second end 32 of the tube 28. The barrel tip 24 defines a central sleeve 38 that is made of hard plastic and cannot be manually compressed closed. The inside diameter of the central sleeve 38 is equal to, or just slightly larger than, the opening diameter of the shaft 40 of the soft dart projectile 14. The presence of the sleeve 38 prevents the second end section 42 of the tube 28 from bending and pinching any soft dart projectile 14 that may be ready for launch.

Although many existing foam dart projectiles can be used, a preferred soft dart projectile 14 has a foam shaft 40, a section cup head 44 and a beveled collar 46. In order to load the toy system 10, the soft dart projectile 14 is loaded into the toy gun 16. More specifically, the shaft 40 of the soft dart projectile 14 is inserted into the central sleeve 38 of the barrel tip 24. The shaft 40 of the soft dart projectile 14 passes through the barrel tip 24 and into the tube 28, until the beveled collar 46 of the soft dart projectile 14 engages the barrel tip 24 and creates a generally air tight seal. Once the soft dart projectile 14 is seated, the handle section 18 is rapidly squeezed by a user. This creates a sudden high pressure inside the internal conduit 36 that displaces the soft dart projectile 14 and launches it into flight.

Figure 3:
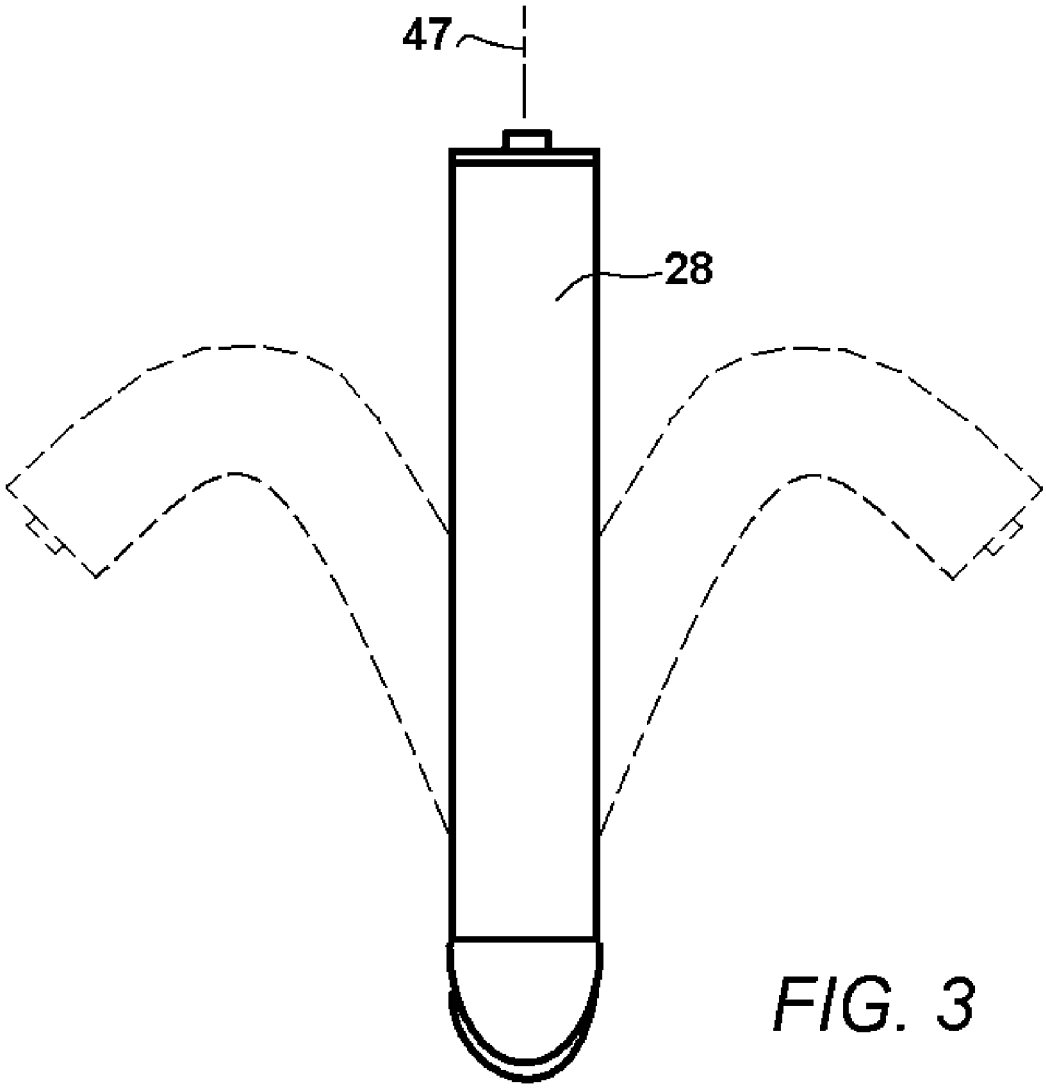
FIG. 3 is a top view of the exemplary system of FIG. 1, showing range of barrel movement.

Referring to FIG. 3, it can be seen that the length of the tube 28 is made exclusively of the closed cell foam material 30. Such material is highly flexible. Accordingly, the handle section 18, the gun body 20, and the first end 31 of the tube 28 can be aligned on a first reference line 47. However, the tube 28 as it progresses can be bent out of the first reference line 47 in any direction without changing the position of the handle section 18, the gun body 20 and the first end 31. Once the tube 28 is bent into a desired direction, the toy system 10 is still free to operate normally. That is, the handle section 18 can still be squeezed to launch the soft dart projectile 14. However, it will be understood that the dart projectile 14 is loaded into the barrel tip 24 at the second end 32 of the tube 28. As a result, the dart projectile 14 will launch in the direction to which the second end 32 of the tube 28. The length and the thickness of the tube 28 combine to enable the tube 28 to bend at least 120 degrees out of the reference line 47 without significant blockage of the internal conduit 36.

The bending of the tube 28 can be severe. All that is required is that the tube 28 remain unkinked so that air can flow through the internal conduit 36 between its first end and its second end. The bend in the tube 28 could also affect the barrel section 22 that retains the soft dart projectile 14. However, the presence of the sleeve 38 prevents the soft dart projectile 14 from becoming affected. The result is that the soft dart projectile 14 always shoots straight, even if the tube 28 is severely bent.

In FIG. 3, the tube 28 of the toy gun 16 is shown bent laterally in the horizontal plane. Such bends can be used to make the toy gun 16 shoot around corners. However, it should be understood that the tube 28 can be bent in any combination of both vertical directions and horizontal directions.

In the embodiment of FIGS. 1-3, the pneumatic burst used to launch the soft dart projectile 14 from the toy gun 16 was created by simply squeezing the handle section 18 and displacing air through the tube 28. Such a system is both effective and cost efficient. However, there are many other mechanical systems used with toy guns to produce a pulse of air on demand. Many such mechanical systems use a spring-loaded piston plunger that can be cocked into a set position. When the piston plunger is released, the spring drives the piston plunger forward and a pulse of air is created.

Figure 4:
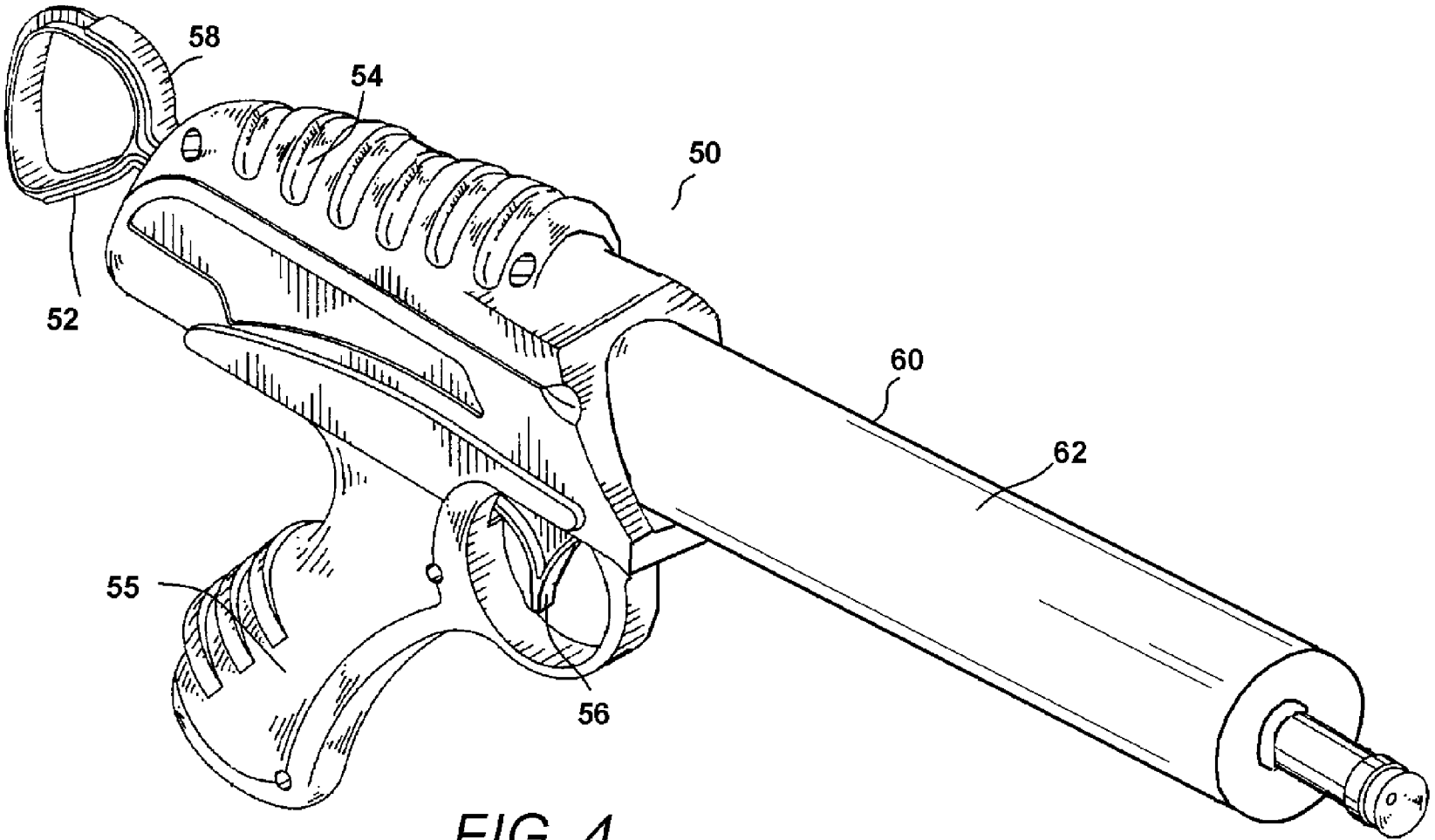
FIG. 4 is a side view of an alternate embodiment of a toy launcher.

The flexible barrel of the present invention can be adapted to guns having such mechanical systems for generating pulses of air. One such embodiment is shown in FIG. 4. Referring to FIG. 4, a toy gun assembly 50 is shown having a mechanical air pulse generating system 52 that includes a handle section 55, a gun body 54, a trigger 56, and a spring-loaded piston plunger 58. The handle section 55, gun body 54 and trigger 56 are molded from rigid plastic. In order to create a burst of air, the spring-loaded piston plunger 58 is pulled back into a cocked position. When the trigger 56 is pressed, the spring-loaded piston plunger 58 is released and moves forward to create a small burst of air. Many such systems exist in the prior art record and are exemplified by U.S. Pat. No. 7,287,526 to Bligh, entitled Toy Projectile Launcher With Slidable Outer Cylinder And Stationary Inner Compression Member, the disclosure of which is incorporated into this specification by reference.

In the embodiment of FIG. 4, it can be seen that a flexible barrel 60 can be affixed to the mechanical air pulse generating system 52. The flexible barrel 60 is the same as has been previously described. The flexible barrel 60 is made from an elongated tube 62 of closed-cell foam. A barrel tip is attached to the distal end of the foam tube 62. The flexible barrel 60 is free to bend in any direction as the mechanical air pulse generating system 52 is activated. As such, the handle section 55 can face in one direction, while the toy gun assembly 50 fires in a different second direction.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A toy gun assembly for launching a soft dart projectile, said assembly comprising:

a handle and a gun body, wherein an air pulse generating system is embodied therein that generates a pulse of displaced air when activated;

a flexible barrel having an outside diameter and an internal conduit, said internal conduit extending between a first end and a second end, wherein said flexible barrel is coupled to said gun body to enable said internal conduit to receive said pulse of displaced air through said first end, and wherein said internal conduit has a diameter no greater than half said outside diameter of said flexible barrel, wherein said flexible barrel is fabricated from a flexible closed-cell foam that enables said flexible barrel to bend more than ninety degrees between said first end and said second end without obstructing said internal conduit.

2. The assembly according to claim 1, further including a barrel tip coupled to said second end of said flexible barrel that defines a rigid tubular sleeve that aligns with said internal conduit.

3. The assembly according to claim 1, wherein said flexible barrel is capable of bending at least 120 degrees without closing said internal conduit.

4. The assembly according to claim 3, wherein said flexible barrel has an outside diameter and a length between said first end and said second end of a distance at least four times said outside diameter.

5. The assembly according to claim 1, wherein said handle defines an internal chamber, and wherein said air pulse generating system is an air bladder defined at least in part by said handle, wherein said handle is fabricated from soft material that can be squeezed to displace air from said internal chamber into said internal conduit of said flexible barrel.

6. The assembly according to claim 1, further including a trigger, wherein said air pulse generating system includes a spring-loaded piston that can be set into a cocked position and released from said cocked position by said trigger.

7. A toy system for launching a soft dart projectile, comprising:

a dart projectile having a head and a flexible shaft, wherein said shaft has an outside diameter;

a pneumatic launcher containing an air pulse generating system that displaces air through a flexible barrel, wherein said flexible barrel defines an internal conduit that extends between a first end and a second end, wherein said second end of said flexible barrel is sized to receive said shaft of said dart projectile therein, and wherein said flexible barrel is fabricated from a flexible closed-cell foam that enables said flexible barrel to bend at least ninety degrees between said first end and said second end without blocking air flow through said internal conduit, and a barrel tip coupled to said second end of said flexible barrel that defines a rigid tubular sleeve that aligns with said internal conduit, wherein said rigid tubular sleeve is sized to enable said shaft of said dart projectile to pass therethrough.

8. The system according to claim 7, wherein said rigid tubular sleeve is at least as long as said shaft of said dart projectile.

9. The system according to claim 7, wherein said flexible barrel is capable of bending at least 120 degrees without closing said internal conduit.

10. The system according to claim 7, wherein said flexible barrel has an outside diameter and a length between said first end and said second end that is more than four times larger than said outside diameter.

11. The assembly according to claim 10, wherein said internal conduit has a diameter no greater than half said outside diameter of said flexible barrel.

12. The system according to claim 7, wherein said pneumatic launcher includes an air bladder that is squeezed by a user to displace air through said air bladder.

13. The system according to claim 12, wherein said pneumatic launcher has a handle that defines at least part of said air bladder, wherein said handle is fabricated from soft material that can be squeezed to displace air through said flexible barrel.

14. The system according to claim 7, wherein said pneumatic launcher further includes a trigger and a spring-loaded piston that can be set into a cocked position, wherein said spring-loaded piston is released from said cocked position by said trigger.

15. A flexible barrel device for a toy dart launcher that launches a dart using pressurized air, said flexible barrel comprising;

a first end;

a second end;

an internal conduit that extends between said first end and said second end, wherein said internal conduit has a conduit diameter large enough to receive at least part of said dart;

wherein said flexible barrel is fabricated from a closed-cell foam material and has an outside diameter that is at least twice as wide as said conduit diameter.

16. The device according to claim 15, wherein said flexible barrel has a length between said first end and said second end that is more than four times larger than said outside diameter.

17. The device according to claim 15, further including a rigid sleeve that extends into said second end of said flexible barrel.

* * * * *